United States Patent [19]

Kausträter

[11] 4,438,676

[45] Mar. 27, 1984

[54] AMMUNITION CONTAINER

[75] Inventor: Gert Kausträter, Augsburg, Fed. Rep. of Germany

[73] Assignee: Kuka Webrtechnik GmbH, Augsburg, Fed. Rep. of Germany

[21] Appl. No.: 384,283

[22] Filed: Jun. 2, 1982

[30] Foreign Application Priority Data

Jun. 2, 1981 [DE] Fed. Rep. of Germany ..... 3121786

[51] Int. Cl.[3] ..... F41D 10/14; F41D 10/42; F41F 9/06; F42B 39/12

[52] U.S. Cl. ..... 89/34; 89/33 BB; 221/279

[58] Field of Search ..... 89/34, 33 BB, 33 B, 89/33 R, 33 BC, 33 BA; 221/198, 279; 220/93; 312/71

[56] References Cited

U.S. PATENT DOCUMENTS

| | | | |
|---|---|---|---|
| 2,147,208 | 2/1939 | Nolan | 89/34 X |
| 2,358,319 | 9/1944 | Dupee | 89/34 |
| 2,364,510 | 12/1944 | Bertran et al. | 89/34 |
| 2,426,995 | 9/1947 | Gibbs | 221/279 X |
| 2,503,116 | 4/1950 | Maillard | 89/33 B |
| 2,541,616 | 2/1951 | Sasser | 89/34 X |
| 3,359,859 | 12/1967 | Herlach et al. | 89/34 |

FOREIGN PATENT DOCUMENTS

| | | | |
|---|---|---|---|
| 550607 | 9/1956 | Belgium | 89/34 |

*Primary Examiner*—Donald G. Kelly

[57] ABSTRACT

An ammunition container has an ammunition supporting platform which is movable upwardly within the outer housing by springs which are loaded by the weight of the ammunition supported thereon. As the ammunition is used, the decrease in the weight of the ammunition thereon allows the springs to recover and elevate the platform to provide a relatively constant upper position for the upper plane of the ammunition supported on the platform.

4 Claims, 4 Drawing Figures

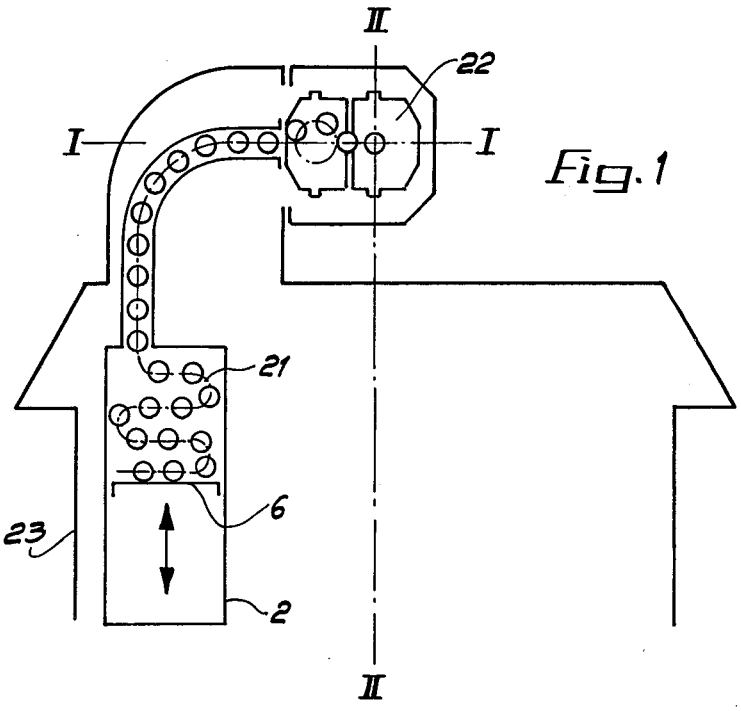
Fig. 1
Fig. 2
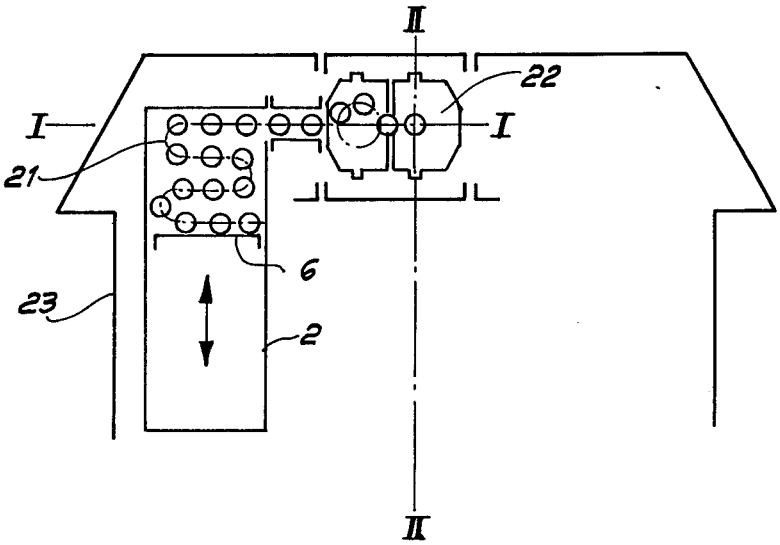

AMMUNITION CONTAINER

BACKGROUND OF THE INVENTION

The invention concerns an ammunition container in the form of a vertical housing that is positioned beneath or alongside an automatic weapon (e.g., machine gun or automatic cannon) and whose rectangular cross section is adapted to accommodate both the bullet length and the amplitude or the zigzag placement of the cartridge belt rising from the base platform. The base platform serves as a lifting means by connection to a line, cable, or similar flexible means of traction, and the platform is moved upwardly by a power source acting upon the means of traction so that the upper level of the ammunition supply upon it always remains at approximately the uppermost position in the container.

An ammunition container of this type is disclosed in U.S. Pat. No. 2,541,616 in which the auxiliary power source is an electric motor operating through a rotary drive. A screw spindle and a corresponding internal screw thread are provided in a traverse connected on both sides to the means of traction, in order to convert this rotary drive into the required lifting movement of the lifting platform. The electric motor must be reversed at the beginning and end of each firing sequence, and also for the purpose of refilling the container. The electric motor naturally requires a source of electric power.

It is an object of the present invention to provide a novel ammunition container of relatively simple construction and which is highly reliable and trouble-free in operation.

It is also an object to provide such an ammunition container in which the motive force is provided by self-contained springs so as to eliminate the necessity for outside or depletable power sources.

SUMMARY OF THE INVENTION

It has now been found that the foregoing and related objects and advantages can be readily attained in a novel ammunition container comprising a housing providing a vertical chamber and which is adapted to be positioned beneath or alongside an automatic weapon. The chamber has a transverse cross section adapted to the length of the bullets to be received therein and the amplitude of the zigzag placement of the magazine belt therewithin. Mounted within the chamber for movement vertically therewithin is a lifting platform having projections thereon which extend through longitudinal slots in opposite sidewalls of the housing.

Flexible drive or traction means is positioned at least partially externally of the housing and has one end connected to the platform projections. Resilient spring means act on the drive means to maintain the upper level of the ammunition supply upon the platform at approximately the uppermost position within the said chamber. The spring means is mounted within a pair of telescopically arranged tube sections of which one tube section is permanently secured at its lower end and the other tube section supports at its upper end a deflection pulley over which passes the drive means which is thus biased by the resilient spring means. The other end of the drive means is fixed at a point remote to the lifting platform. As a result, the spring means is loaded by loading of ammunition on the platform and raises the platform as the ammunition is discharged from the container.

The springs provided to furnish the auxiliary force produce no kinetic energy; rather, elastic force is always produced by stretching the latter, which in the present case is accomplished by gravity-loading when the ammunition container is loaded with ammunition. If the springs are then compressed, their elastic force is always latently present and available without requiring any switching action or a rotary drive with attendant conversion into longitudinal motion, as in the case of the prior technological development cited. Particularly advantageous is the fact that, according to the invention, the elastic tension takes effect on the cable attached to the lifting platform over loose sheaves. The kinetics of the so-called loose sheaves, which travel only half as far as the lifting platform, permit the spring length to be varied by only half the lifting height, while the lifting platform rises at the same time to the full lifting height. This results in the advantage that, at high spring resistance, advantage may be taken of the linear range of the spring characteristic, which functions with especially uniform linearity over the entire lifting height.

At the same time, the elastic force advantageously produces a lifting effect that is opposed by the weight of the ammunition belt placed on the lifting platform. By designing this elastic force appropriately, a balance may therefore be achieved. Addition or subtraction of elastic force then corresponds to an addition or subtraction of ammunition weight. When springs with a maximally uniform linear spring characteristic are employed, after any filling or withdrwal of ammunition from the ammunition container, the lifting platform moves downwardly or upwardly so that, in the manner already described, the upper level of the ammunition supply on the lifting platform always remains in its approximately uppermost position, in which between this upper level and the automatic weapon there is a magazine loop from which the weapon can fire a burst without any delay.

Coil springs are the primary candidate for consideration as springs. They may be compression springs.

To ensure smooth operation in the transmission of the elastic force and, in particular, to avoid tilting, it is desirable that two pairs of rollers be mounted on each projection, and to use rails to guide the rollers. In addition, it has proved to be advisable to swing-mount the rollers to ensure that the roller pairs turn easily.

BRIEF DESCRIPTION OF THE DRAWINGS

FIG. 1 is a partially diagrammatic illustration of an automatic weapon installation showing the ammunition container of the present invention disposed below the automatic weapon;

FIG. 2 is a similar illustration showing the ammunition container disposed alongside the automatic weapon;

DETAILED DESCRIPTION OF THE ILLUSTRATED EMBODIMENT

Figure 3:
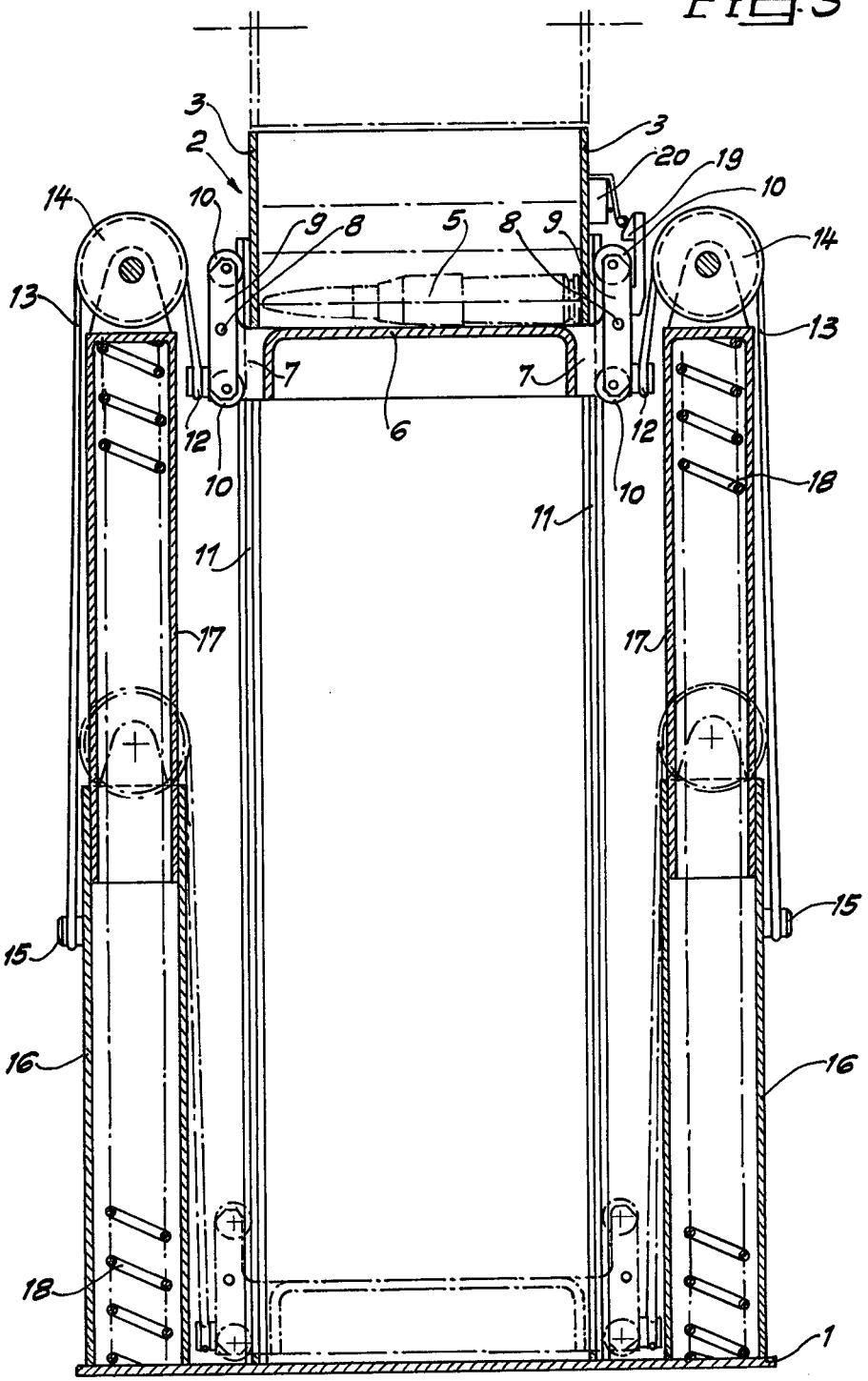
FIG. 3 is an illustration of the ammunition container in vertical longitudinal section with a cartridge shown in phantom line on the platform member and with the platform member partially illustrated in phantom line, and with some elements shown in broken line for clarity of illustration.
Figure 4:
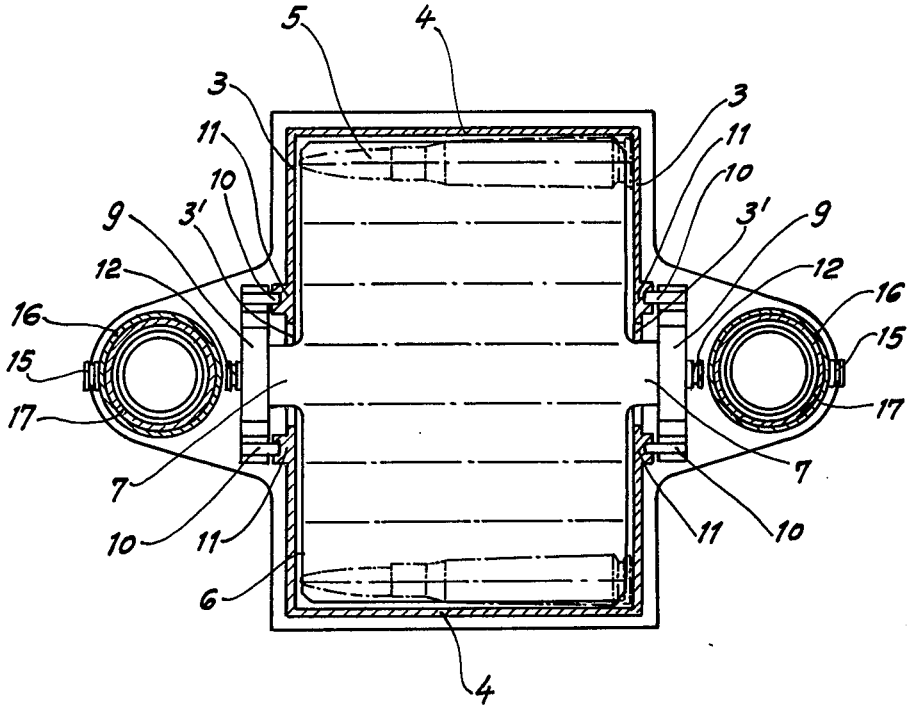
FIG. 4 is a cross-sectional view thereof along the line 4—4 of FIG. 3.

Turning first in detail in FIGS. 3 and 4, an ammunition container generally designated by the numeral 2 is attached to the base plate 1 at its lower end. The ammunition container 2 includes a housing generally designated by the numeral 30 and of rectangular cross section defined by two pairs of opposed side walls 3 and 4. A lifting platform 6 may be moved vertically within the chamber defined by the housing 30 and has two horizontally extending projections 7 thereon which are disposed opposite one another. These projections extend outwardly through longitudinal slots 3' in the opposed sidewalls 3 of the housing 30 and extend over the entire lifting height of the platform 6 within the housing 2.

Adjacent the outer end of each projection 7 is a horizontally disposed axle bolt 8, on both ends of which are carried vertically disposed balancing arms 9. Rotably supported on each end of each balancing arm 9 are rollers 10, positioned one above the other, and each pair of rollers 10 is guided and travels within a vertically extending roller rail 11 on the housing.

Disposed on the base 1 outwardly of the sidewalls 3 are two vertically oriented tube pairs each comprised of an outer tube section 16 and an inner tube section 17 slideable therewithin. Mounted on the upper end of the inner tube section 17 are pulleys 14. Disposed within the tube sections 16,17 are compression springs 18 with a linear spring characteristic extending over as long a spring path as possible. Each spring 18 takes effect over a lifting path of the pulley 14 which extends between the upper position of lifting platform 6 as illustrated by solid lines, and the lower position of lifting platform 6 as indicated by dots and dashes.

Attached to each projection 7 at point 12 is one end of a flexible cable 13, which then passes over the pulley 14 and has its other end secured to the lower tube section 16 at point 15.

A cam 19 on the balancing arm 9 situated on the right side in FIG. 3 engages, in its upper most lifting position, the control lever of an electrical switch that, when the uppermost position is reached, produced a signal that indicates to the gunner the impending exhaustion of his ammunition supply.

A number of bullets 5 is expended in a burst of fire, which together with the associated portion of the disintegrating carrier belt (not explained in further detail), represents a perceptible proportion of the weight load on the platform 6. The loss of this weight portion reduces the load on the pair of compression springs 18 and causes them to recover partially from their compressed condition and raises the platform 6. In accordance with FIGS. 1 and 2, this raising motion is limited by compression of the magazine loop 21 immediately ahead of the automatic weapon 22.

As seen in FIGS. 1 and 2, the preferred application for the inventive container is to automatic weapons that swivel about a horizontal axis I—I outside an armored turret 23 (FIG. 1) or inside the latter (FIG. 2). The armored turret 23 rotates about a vertical axis II—II in an armored vehicle (not illustrated). Thus, it can be seen that the present invention provides a novel and relatively simply constructed ammunition container which will exhibit a long life and relatively trouble free operation. The motive power to elevate the ammunition therewith is provided by springs which are loaded by the loading of the ammunition into the container.

I claim:

1. Ammunition container comprising:

A. a housing providing a vertical chamber and which is adapted to be positioned beneath or alongside an automatic weapon said chamber having a transverse cross section adapted to the length of the bullets to be received therein and the amplitude of the zigzag placement of the magazine belt therewithin said housing having opposite sidewalls provided with longitudinal slots;

B. a lifting platform mounted within said chamber for movement vertically therewithin over a lifting height, said platform having projections thereon extending through said longitudinal slots in said opposite sidewalls of said housing, said slots extending over the lifting height for said platform within said housing;

C. flexible drive means positioned at least partially externally of said housing and having one end connected to said platform projections; and D. resilient spring biased pulley means acting on said drive means to maintain the upper level of the ammunition supply upon the platform at approximately the uppermost position, within said chamber, said resilient spring biased pulley means includes spring means being mounted within a pair of telescopically arranged tube sections of which one tube section is permanently secured at its lower end and the other tube section supports at its upper end a pulley over which is passed the drive means, the other end of said flexible drive means being fixed at a point remote to said lifting platform, whereby said spring means is loaded by loading of ammunition on said platform and raises said platform as the ammunition is discharged from the container.

2. The ammunition container in accordance with claim 1, wherein pairs of rollers are mounted on the outer surface of each of said projections on said platform.

3. The ammunition container in accordance with claim 2, wherein there are included guide rails on said housing cooperating with said rollers to provide tracks for each pair of rollers.

4. The ammunition container in accordance with either of said claims 2 or 3, wherein said rollers of each pair are mounted adjacent opposite ends of a vertically disposed support member pivotably mounted intermediate its length on its associated platform projection.

* * * * *

UNITED STATES PATENT AND TRADEMARK OFFICE

CERTIFICATE OF CORRECTION

PATENT NO. : 4,438,676

DATED : March 27, 1984

INVENTOR(S) : Gert Kaustrater

It is certified that error appears in the above—identified patent and that said Letters Patent is hereby corrected as shown below:

On the title page, Item /73/ should read:

/73/ Assignee: KUKA Wehrtechnik GmbH --

Signed and Sealed this

Fifth Day of March 1985

[SEAL]

*Attest:*

DONALD J. QUIGG

*Attesting Officer* *Acting Commissioner of Patents and Trademarks*